United States Patent [19]

Ohira et al.

[11] Patent Number: 5,045,884

[45] Date of Patent: Sep. 3, 1991

[54] TONER SUPPLY ARRANGEMENT

[75] Inventors: Tadashi Ohira; Akira Ohhata, both of Osaka, Japan

[73] Assignee: Minolta Camera Kabushiki Kaisha, Osaka, Japan

[21] Appl. No.: 488,873

[22] Filed: Mar. 6, 1990

[30] Foreign Application Priority Data

Mar. 8, 1989 [JP] Japan ..... 1-055381

[51] Int. Cl.[5] ..... G03G 15/06

[52] U.S. Cl. ..... 355/245; 118/653; 355/209; 355/260

[58] Field of Search ..... 355/260, 245, 208, 209, 355/246, 326, 327; 118/653, 656, 694; 222/DIG. 1

[56] References Cited

U.S. PATENT DOCUMENTS

| | | | |
|---|---|---|---|
| 4,142,655 | 3/1979 | Fantuzzo | 222/DIG. 1 |
| 4,235,194 | 11/1980 | Wada et al. | 222/DIG. 1 |
| 4,370,053 | 1/1983 | Hirayama et al. | 355/245 |
| 4,579,443 | 4/1986 | Abuyama et al. | 355/314 |
| 4,602,862 | 7/1986 | Wyble | 222/DIG. 1 |
| 4,919,071 | 4/1990 | Gatti | 355/245 |

FOREIGN PATENT DOCUMENTS

| | | | |
|---|---|---|---|
| 0096679 | 4/1988 | Japan | 355/260 |
| 0138373 | 6/1988 | Japan | 355/260 |

*Primary Examiner*—A. T. Grimley
*Assistant Examiner*—Robert Beatty
*Attorney, Agent, or Firm*—Burns, Doane, Swecker & Mathis

[57] ABSTRACT

A toner supply arrangement for use in a developing apparatus which includes a plurality of toner accommodating containers provided in the developing apparatus, a toner transport device for transporting toner accommodated in each of the plurality of toner accommodating containers to the developing apparatus, a driving unit for driving the toner transport device; a first toner detecting device for detecting presence or absence of toner accommodated in each of the plurality of toner accommodating containers, a cover member for selectively opening or closing an opening for each of the plurality of toner accommodating containers, an open/-close detecting device for detecting opening or closing of the cover member, and a control device for actuating the first toner detecting means upon detection of the opening or closing of the cover member so as to apply a control signal to the driving unit according to result of detection of the toner detecting device.

20 Claims, 8 Drawing Sheets

TONER SUPPLY ARRANGEMENT

BACKGROUND OF THE INVENTION

The present invention generally relates to electrophotography, and more particularly, to a toner supply arrangement for supplying toner to a toner replenishing section installed in a developing unit of a copying apparatus and the like, based on an electrophotographic process.

It has been a recent trend that copying apparatuses and printers, etc. are utilized extremely frequently, and it is not seldom that forty to fifty thousand sheets of copies are taken by one unit of such an apparatus.

However, since the copying apparatuses and the like conventionally provided are generally arranged to accommodate toner in an amount only about 700 g, in the case where copying is effected in a large quantity as described above, it becomes necessary to replenish the toner frequently.

Accordingly, in an image forming apparatus for an office or the like where copying is to be effected in a large amount, it is desirable to arrange that the apparatus can accommodate as much toner as possible.

More specifically, if the apparatus is capable of accommodating toner of about 2 kg, toner is not required to be replenished for nearly one month, and it also become possible to omit work for replenishing toner at the side of a user by leaving such toner replenishing work to skilled servicing personnel.

However, due to the fact that if a large amount of toner in about 2 kg or thereabout is accommodated in one container, the toner at the bottom of the container tends to be solidified, it is required to mix and stir the toner by providing a stirring device. Moreover, since the pressure of the toner to be applied to a toner transport vane provided at the bottom portion of the container is increased, a motor with a large output is required for driving such a vane. In this case, if the above motor and motors for an optical system, a photosensitive member, and a paper transport system, etc. are driven simultaneously, power consumption will undesirably exceed an allowable value, thus making it impossible to replenish toner during formation of an image.

Furthermore, since it becomes difficult to accurately detect the remaining amount of toner when a size of the container is increased, there is a possibility that a faulty image at a low density is formed due to a delay in the toner replenishing period.

SUMMARY OF THE INVENTION

Accordingly, an essential object of the present invention is to provide a toner supply arrangement for use in a developing apparatus which is capable of accommodating a large amount of toner.

Another object of the present invention is to provide a toner supply arrangement of the above described type which is capable of positively effecting toner supply to the developing apparatus.

A further object of the present invention is to provide a toner supply arrangement of the above described type provided with a plurality of toner accommodating containers, and capable of supplying toner from the toner accommodating container positively replenished with the toner, to the developing apparatus.

A still further object of the present invention is to provide a toner supply arrangement of the above described type which is simple in construction and stable in functioning, and can be readily incorporated in a developing apparatus at low cost.

In accomplishing these and other objects, according to one preferred embodiment of the present invention, there is provided a toner supply arrangement for use in a developing apparatus, which includes a plurality of toner accommodating containers provided in said developing apparatuses, a toner transport means for transporting toner accommodated in each of said plurality of toner accommodating containers to said developing apparatus, a driving means for driving said toner transport means, a first toner detecting means for detecting presence or absence of toner accommodated in each of said plurality of toner accommodating containers, a cover member for selectively opening or closing an opening for each of said plurality of toner accommodating containers, an open/close detecting means for detecting opening or closing of said cover member, and a control means for actuating said first toner detecting means upon detection of the opening or closing of said cover member so as to apply a control signal to said driving means according to the detected result of said toner detecting means.

By the arrangement according to the present invention as described above, since the toner is accommodated in the plurality of toner hoppers, even if the amount of toner to be contained in each of the toner hoppers is small, a large amount of toner may be accommodated in the image forming apparatus on the whole. Moreover, when the door means is opened or closed, the state of toner empty is first checked, and then, toner supply function is continued.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
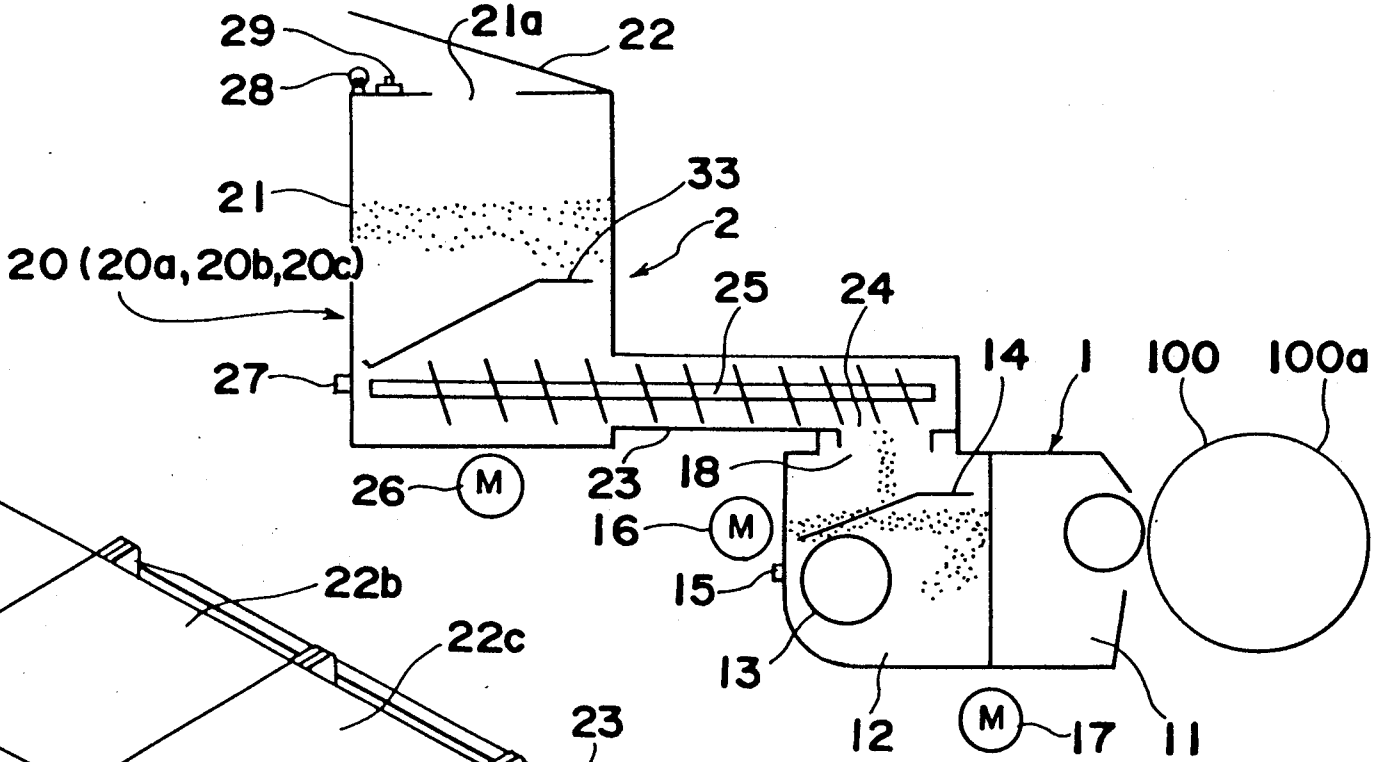
FIG. 1 is a schematic side sectional view of a developing apparatus, provided with a toner supply arrangement for supplying toner to the developing apparatus, directly related to the present invention.

Before the description of the present invention proceeds, it is to be noted that like parts are designated by like reference numerals throughout the accompanying drawings.

Figure 2:
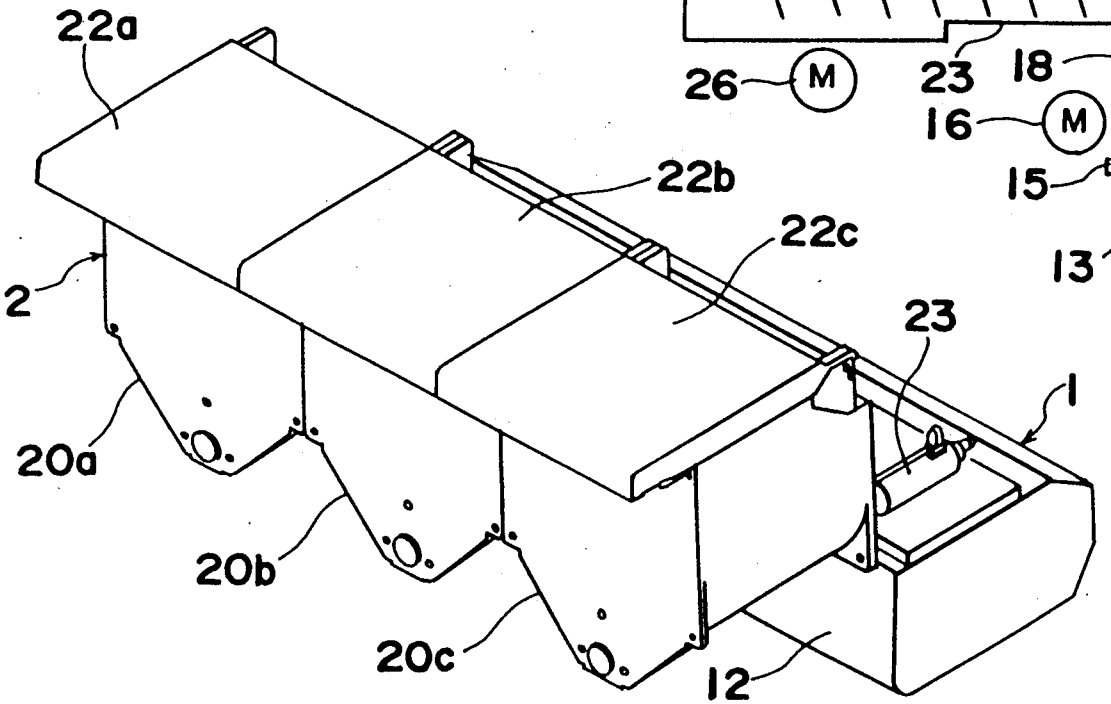
FIG. 2 is a perspective view of the developing apparatus and the toner supply arrangement shown in FIG. 1.

Referring now to the drawings, there is shown in FIGS. 1 and 2, a developing apparatus 1 to be installed on an image forming apparatus such as a copying apparatus or the like (not particularly shown), and provided with a toner supply arrangement 2 which supplies toner to the developing apparatus 1 and is directly related to the present invention.

In FIGS. 1 and 2, the developing apparatus 1 generally includes a developing section 11 for feeding toner onto an electrostatic latent image to be formed on an outer peripheral photosensitive surface 100*a* of a photosensitive or photoreceptor drum 100, and a sub-hopper section 12 for replenishing the toner to the developing section 11.

The sub-hopper section 12 includes a rotatable stirring vane 13 for mixing and stirring toner and a detecting plate 14 movably disposed therein to follow the surface level of toner, a sensor 15 disposed at a predetermined level on a wall of the sub-hopper section 12 for detecting the position of said detecting plate 14, a replenishing means (not particularly shown) for replenishing the toner into the developing section 11, and a toner stirring motor 16 and a toner replenishing motor 17 for respectively driving said stirring vane 13 and the replenishing means referred to above.

The toner supply arrangement 2 directly related to the present invention and disposed behind the developing apparatus 1 includes three main hoppers 20*a*, 20*b* and 20*c* (generally represented by Numeral 20 on the whole) having similar shape and construction.

Each of the main hoppers 20 includes a hopper portion 21 having an opening 21*a* at its upper portion and a toner transport pipe 23 provided at the bottom portion of the hopper portion 21 for communication therewith, and a lid or door member 22 pivotally provided on the hopper portion 21 so as to selectively open or close the upper opening 21*a* of the hopper portion 21. The toner transport pipe 23 is extended into an upper portion of the sub-hopper section 12 for the developing apparatus 1, with a toner supply port 24 formed at the forward end of said toner transport pipe 23 being arranged to confront a toner receiving port 18 of the sub-hopper section 12. A spiral member 25 is rotatably disposed to extend from the bottom portion of the hopper portion 21 through the toner transport pipe 23 so as to be driven for rotation by a toner transport motor 26. At the bottom portion of the hopper member 21, a detecting plate 33 for detecting presence or absence of toner is provided, together with a sensor 27 disposed at a predetermined level on a wall of the hopper portion 21 for detecting the position of the detecting plate 33, while on the upper edge of said hopper member 21, a lamp 28 and a door switch 29 for detecting opening or closing of the door 22 are provided.

Figure 3:
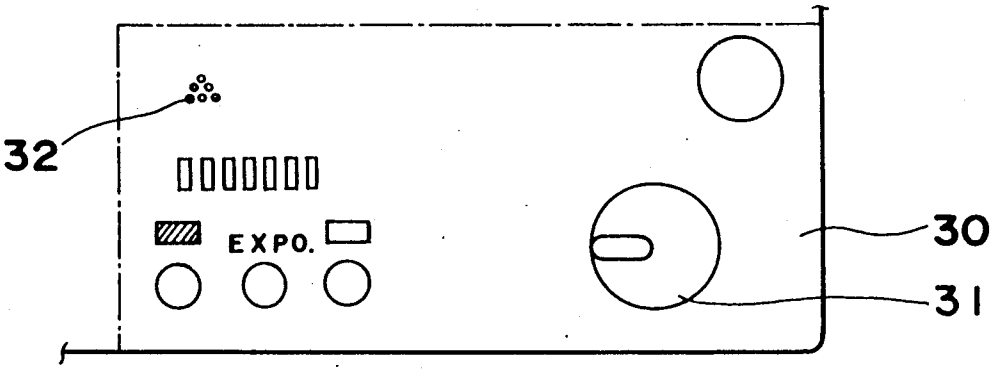
FIG. 3 is a fragmentary top plan view of a control panel for an image forming apparatus provided with the toner supply arrangement of the present invention.

As shown in FIG. 3, on a control panel 30 of the image forming apparatus, there are provided a print key 31, and an empty state indicating lamp 32 for indicating that all of the main hoppers 20*a*, 20*b* and 20*c* are in the state of "toner empty".

Figure 4:
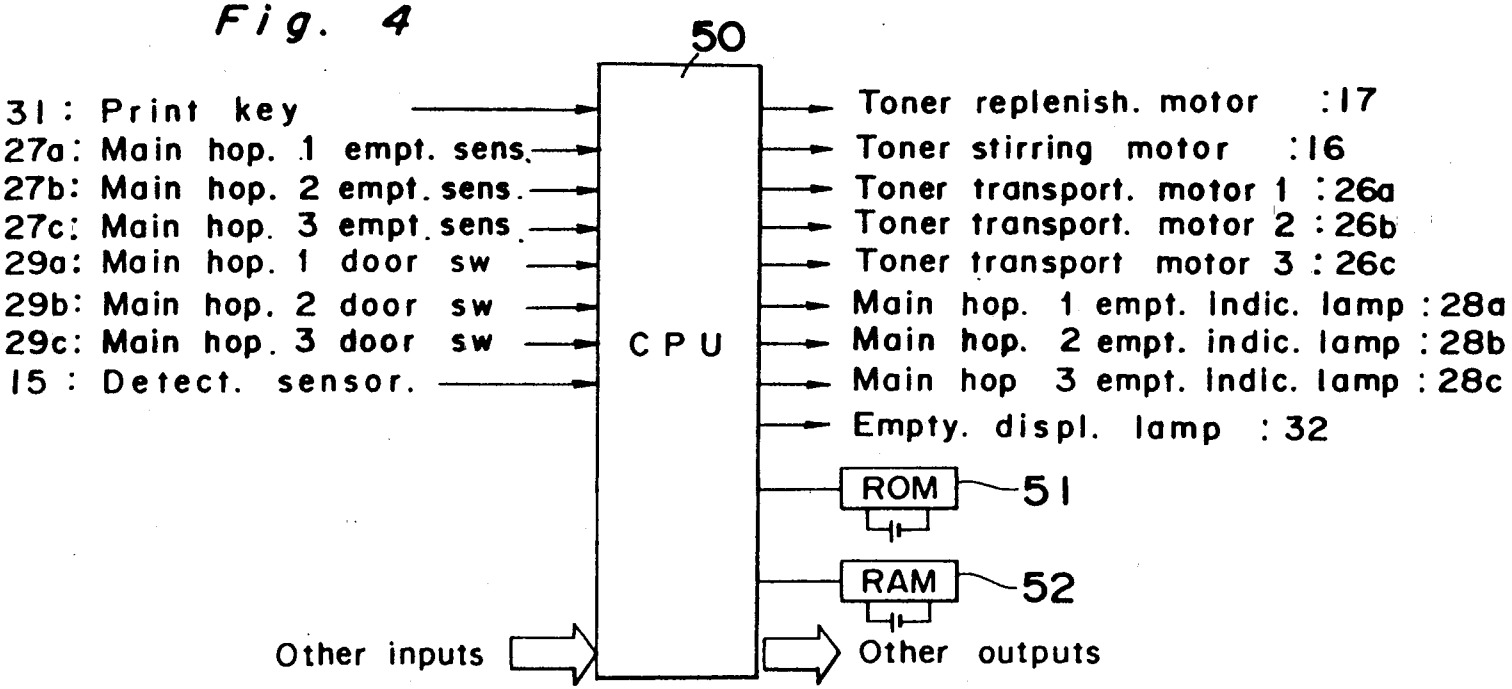
FIG. 4 is a diagram showing a general circuit construction of a control unit for the toner supply arrangement according to the present invention.

In a diagram of FIG. 4 showing a circuit construction of a control unit, the detecting sensor 15, the toner stirring motor 16 and the toner replenishing motor 17 for the developing apparatus 1, the toner transport motors 26*a*, 26*b* and 26*c*, the sensors 27*a*, 27*b* and 27*c*, the lamps 28*a*, 28*b* and 28*c*, and door switches 29*a* 29*b* and 29*c* for the respective three main hoppers 20*a*, 20*b* and 20*c* of the toner supply arrangement 2, and the print key 31 and the empty state display lamp 32 for the control panel 30, etc. are coupled with a microcomputer or central processing unit 50 (referred to as a CPU 50 hereinafter) together with other inputs and outputs so as to be collectively controlled by said CPU 50. In the diagram, the numerals 1,2 and 3 affixed to the respective parts represent that such parts correspond to the main hoppers 20*a*, 20*b* and 20*c*.

In the developing apparatus 1 and the toner supply arrangement 2 having constructions as described so far, when the toner is supplied to the photoreceptor drum 100 from the developing apparatus 1, and the amount of the toner in the developing section 11 is reduced, the toner corresponding in amount to the amount of reduction is replenished from the sub-hopper 12 to the developing section 11.

In the sub-hopper 12, the detecting plate 14 is lowered as the toner is consumed, and upon arrival of the plate 14 at the predetermined level, the sensor 15 is actuated, and thus, a toner replenishing signal representing such a state is outputted to the CPU 50.

In the case where toner is accommodated within each of the main hoppers 20*a*, 20*b* and 20*c*, toner is first supplied to the sub-hopper 12 from the main hopper 20*a* at the innermost side by the CPU 50.

In the main hopper 20*a*, upon energization of the motor 26*a*, the spiral member 25*a* starts rotation, and the toner within the hopper portion 21*a* is transported towards the forward end of the toner transport pipe 23*a* so as to be supplied by dropping into the sub-hopper 12 through the toner supply port 24*a*, and thus, the toner level within the sub-hopper 12 is restored to the predetermined value. Meanwhile, in the similar manner as in the sub-hopper 12, the detecting plate 33*a* in the main hopper 20*a* is lowered as the toner is consumed, and upon arrival of the detecting plate 33*a* at the predetermined level, the sensor 27*a* is actuated, with a toner replenishing signal indicating such state being applied to the CPU 50.

When the toner in the main hopper 20*a* is consumed to be the empty state, the CPU 50 detects the state based on the signal from the sensor 27*a* and illuminates the lamp 28*a*.

Then, upon receipt of the toner replenishing signal from the sensor 15, the CPU 50 drives the motor 26*b* for the main hopper 20*b* at the central portion so as to supply the toner therefrom into the sub-hopper 12 in the similar manner. Further, when the toner in the central main hopper 20*b* has been consumed, the toner is supplied from the main hopper 20*c* at their foremost position. In other words, the main hoppers 20*a*, 20*b* and 20*c* are driven in the order or cycle of 20*a* 20*b* 20*c*, and this cycle is memorized in a ROM (read only memory) 51 connected to the CPU 50 and backed up by a power supply (FIG. 4), and is maintained even when the toner is replenished into the main hopper 20 in the empty state.

For the toner replenishment with respect to the main hoppers 20, the door members 22 are opened to ensure lighting of the lamps 28, and the toner is replenished to the main hopper 20 in which the lamp 28 is lit. Needless to say, the toner may be replenished into the main hopper 20 whose lamp 28 is not lit, depending on necessity.

Subsequently, control of the toner supply arrangement will be described in detail with reference to flowcharts in FIGS. 5 through 11.

Figures 5, 6, 7:
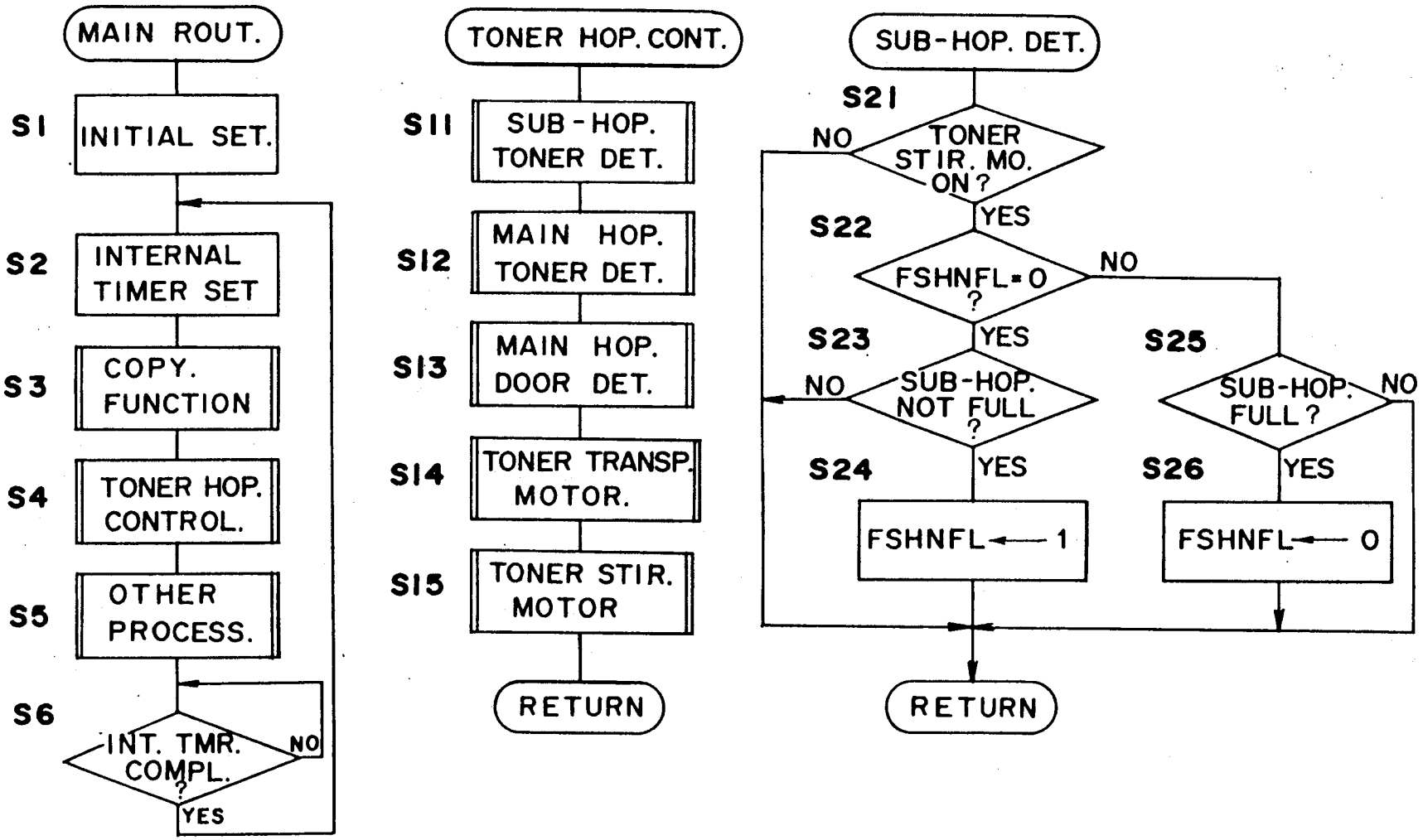
FIG. 5 is a flow-chart for a main routine showing a general flow of an image forming apparatus.
FIG. 6 is a flow-chart for a toner hopper control routine.
FIG. 7 is a flow-chart for a sub-hopper detection control routine.

<Main routine: FIG. 5>

The routine in FIG. 5 represents a general flow of the image forming apparatus to which the toner supply arrangement of the present invention may be applied.

Upon turning on the power source for the image forming apparatus, initialization of respective registers for the CPU 50 and clearing of RAM, etc. are effected at step S1, with an internal timer being set at Step S2.

At Step S3, copy function routine is executed. At Step S4, toner hopper control routine is performed, while at Step S5, other processings are respectively executed.

At Step S6, completion of the internal timer as set at Step S2 is checked, and if it is completed, the procedure again returns to Step S2.

<Toner hopper control routine: FIG. 6>

FIG. 6 represents a routine for controlling functions of the main hoppers 20 and sub-hopper 12.

At Step S11, the toner empty state of the subhopper 12 is checked, and at Step S12, the toner empty state of the main hoppers 20 is judged, while at Step S13, open or close stat of the doors 22 is checked.

Driving control of the toner transport motor 17 is effected at Step S14, and that of the toner stirring motor 16 is executed at Step S15.

Contents of processings at the respective Steps will be described in detail hereinbelow.

<Sub-hopper detection control: FIG. 7>

In the routine of FIG. 7, it is judged whether or not the predetermined amount of toner is present in the sub-hopper 12, i.e. whether or not the state is such that toner should be supplied from the main hopper 20 to the sub-hopper 12.

At Step S21, judgement is made as to whether or not the toner stirring motor 16 is in the driven state, and if the motor 16 is not in the driven state, the procedure returns to the toner hopper control routine, while on the contrary, if the motor 16 is being driven, it is judged at Step S22 whether or not a sub-hopper not full flag (referred to as "FSHNFL" hereinafter) is "0". It is to be noted here that the FSHNFL has been set to "0" at the initial setting Step S1 of the main routine at the starting of the program.

In the case where the FSHNFL is "0", it is checked at Step S23 whether or not the toner in the sub-hopper 12 is below the predetermined amount (insufficient state) based on the output of the sensor 15. If the toner above the predetermined amount is present in the sub-hopper 12, the procedure returns to the toner hopper control routine, while when the toner amount therein is insufficient, the FSHNFL is altered to "1" at Step S24 so as to return to the toner hopper control routine.

Meanwhile, in the case where the FSHNFL is "1", judgement is made at Step S25 as to whether or not the toner amount in the sub-hopper 12 is above the predetermined amount based on the output from the sensor 15, and if the toner more than the predetermined amount is not present, the procedure returns to the toner hopper control routine as it is, while on the contrary, if the toner above the predetermined amount is present, the FSHNFL is changed to "0" at Step S26 so as to return to the toner hopper control routine.

Figure 8:
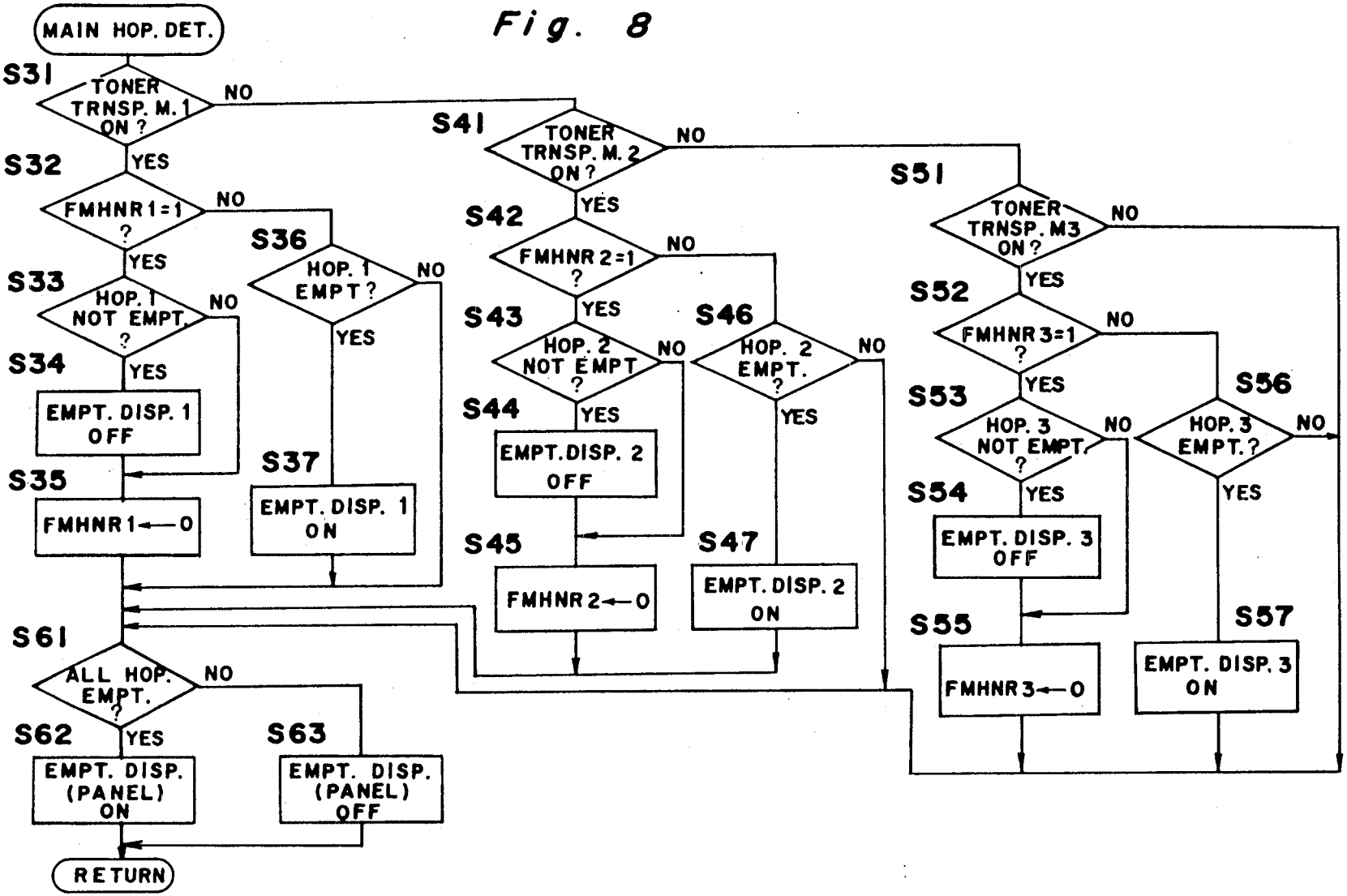
FIG. 8 is a flow-chart for a main hopper toner detection control.

<Main hopper toner detection control: FIG. 8>

In the routine in FIG. 8, the toner empty detection of the main hoppers, and display therefor are effected.

(1) In the steps from Step S31 to S37, the toner empty state of the main hopper 20*a* is checked based on the output signal from the sensor 27*a*, and if the hopper 20*a* is "empty", the empty display lamp 28*a* is illuminated.

At Step S31, it is checked whether or not the motor 26*a* for the main hopper 20*a* is being driven, and if said motor 26*a* is being driven, judgement is made at Step S32 as to whether or not a main hopper not empty detection request flag (referred to as FMHNR 1 hereinafter) is "1". It is to be noted here that the FMHNR 1 to 3 have been set to "1" at the initial setting Step S1 of the main routine at the starting of the program.

When the FMHNR 1 is "1", it is judged, at Step S33, whether or not the toner is present in the main hopper 20*a* based on the output of the sensor 27*a*, and if the toner is present, the main hopper 1 empty display lamp 28*a* is turned off at Step S34, and the FMHNR 1 is altered to "0" at Step S35, while in the case where the toner is judged to be absent at Step S33, the procedure jumps to Step S35.

When the FMHNR 1 is judged to be "0" at Step S32, it is checked, at Step S36, whether or not the main hopper 20*a* is in the empty state based on the output of the sensor 27*a*, and if the hopper 20*a* is in the empty state, the main hopper 1 empty display lamp 28*a* is lit at Step S37, while when the toner remains within the main hopper 20*a*, the procedure jumps over Step S37 so as to shift to the next step.

(2) In the steps from Step S41 to Step S47, the toner empty state of the main hopper 20*b* is judged based on the output signal from the sensor 27*b*, and if the hopper 20*b* is "empty", the main hopper 2 empty display lamp is illuminated, while if said hopper 20*b* is not "empty", the display lamp is de-energized.

Meanwhile, in the flow from Step S51 to S57, the toner empty state of the main hopper 20*c* is judged based on the output signal from the sensor 27*c*, and if the hopper 20*c* is "empty", the state is displayed by the main hopper empty display lamp, while when said hopper 20*c* is not "empty", the display is turned off.

In the above procedure, since the contents of processings from Steps S41 to S47, and those from S51 to S57 are generally similar to the processing contents from S31 to S37 described earlier, detailed description thereof is abbreviated here for brevity of explanation.

Furthermore, in the case where the main hoppers 20*a*, 20*b* and 20*c* are judged to be empty, the state is memorized according to each of the main hoppers in a RAM (random access memory) 52 connected to the CPU 50 and backed up by a power supply (FIG. 4).

(3) At Step S61, on the basis of the results of processings effected from Steps S31 to S37, S41 to S47, and S51 to S57, it is checked whether or not all of the main hoppers 20*a*, 20*b* and 20*c* are in the toner empty state. In the case where all the main hoppers 20 are in the empty state, the empty display lamp 32 of the control panel 30 is illuminated at Step S62. On the contrary, when all of the main hoppers 20 are not in the empty state, i.e. one or more main hoppers 20 are not in the empty state, the empty display lamp 32 is turned off at Step S63 and the procedure returns to the toner hopper control routine.

Figure 9:
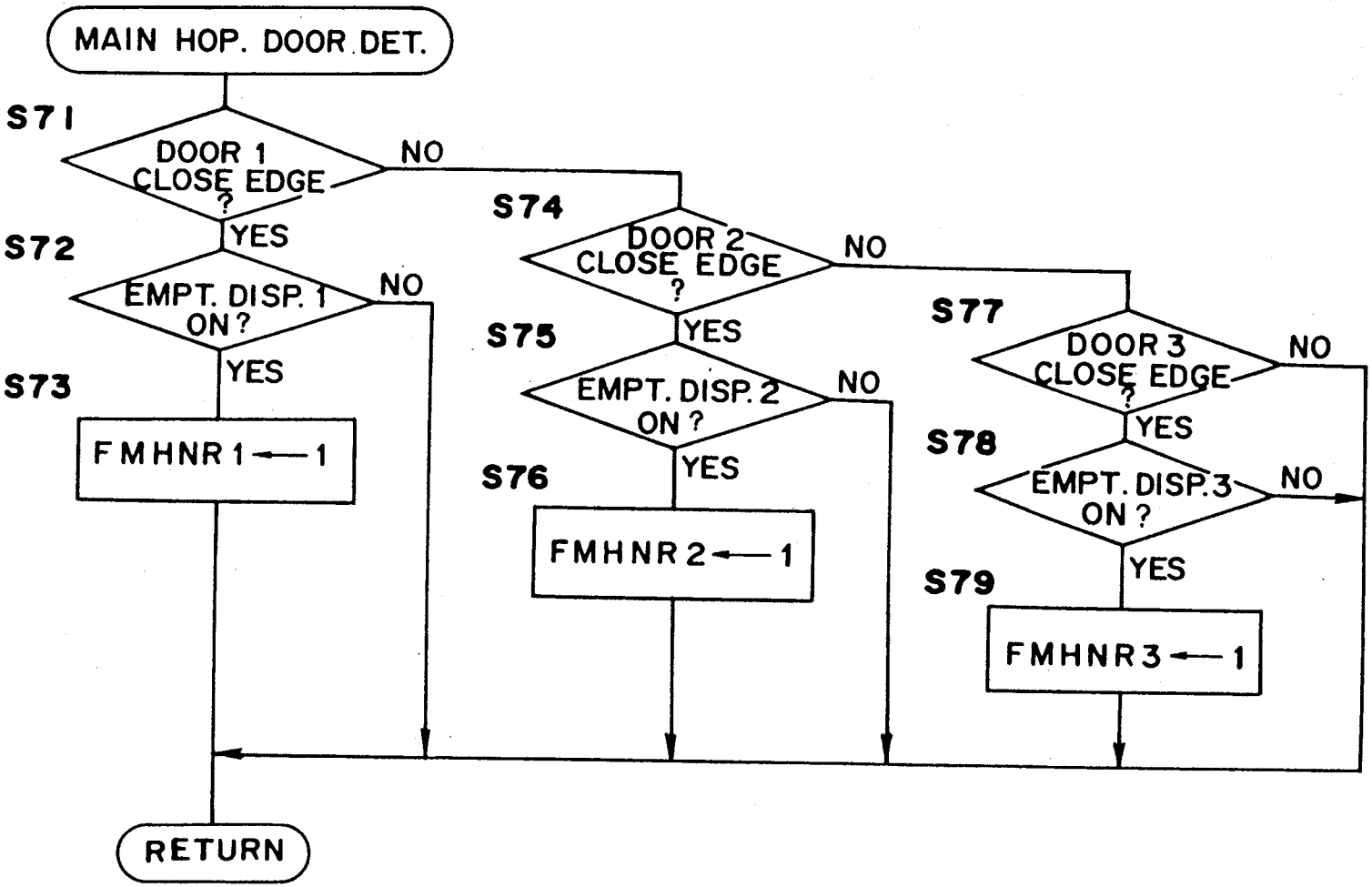
FIG. 9 is a flow-chart for a main hopper door open/close detection control, FIGS. 10(*a*) and 10(*b*) are flow-charts for a toner transport motor control.

<Main hopper door open/close detection control: FIG. 9>

Here, opening or closing of the door member 22 of the main hopper 20 is detected.

The steps from Step S71 to S73 relate to processing contents for detecting open or closed state of the door member 22 of the main hopper 20*a*.

At Step S71, opening or closing of the door member 22*a* is judged by detecting the closed edge of a signal from a door switch 29*a*. It is to be noted here that the closed edge means a state in which the signal applied from the switch 29*a* to the CPU 50 is changed over from the on state to off state, or from the off state to on state by closing the door member 22*a* from the opened state.

Upon detection of the closed edge by opening or closing the door member 22*a*, it is judged at Step S72 whether or not the lamp 28*a* is lit, i.e. whether or not the main hopper 20*a* is memorized to be empty in the RAM 52, when the lamp 28*a* is lit, the FMHNR 1 is set to "1" at Step S73, while on the contrary, if the lamp 28*a* is not lit, the procedure returns to the main routine as it is.

Steps from Step S74 to S76, and S77 to S79 relate to processing contents with respect to the main hoppers 20*b* and 20*c* respectively, which are similar to the processing contents for the Steps S71 to S73 described earlier, and therefore, detailed description thereof is abbreviated for brevity.

In the foregoing steps, upon opening or closing of the door members 22 for the main hoppers 20, the on state of the lamp 28 is ensured, and the FMHNR is changed to "1" when the lamp 28 is lit.

Furthermore, in the case where the door members 22 (22*a*,22*b*,22*c*) are judged to be open or closed state, the state is memorized according to each of the main hoppers in a RAM 52.

Figure 10A:
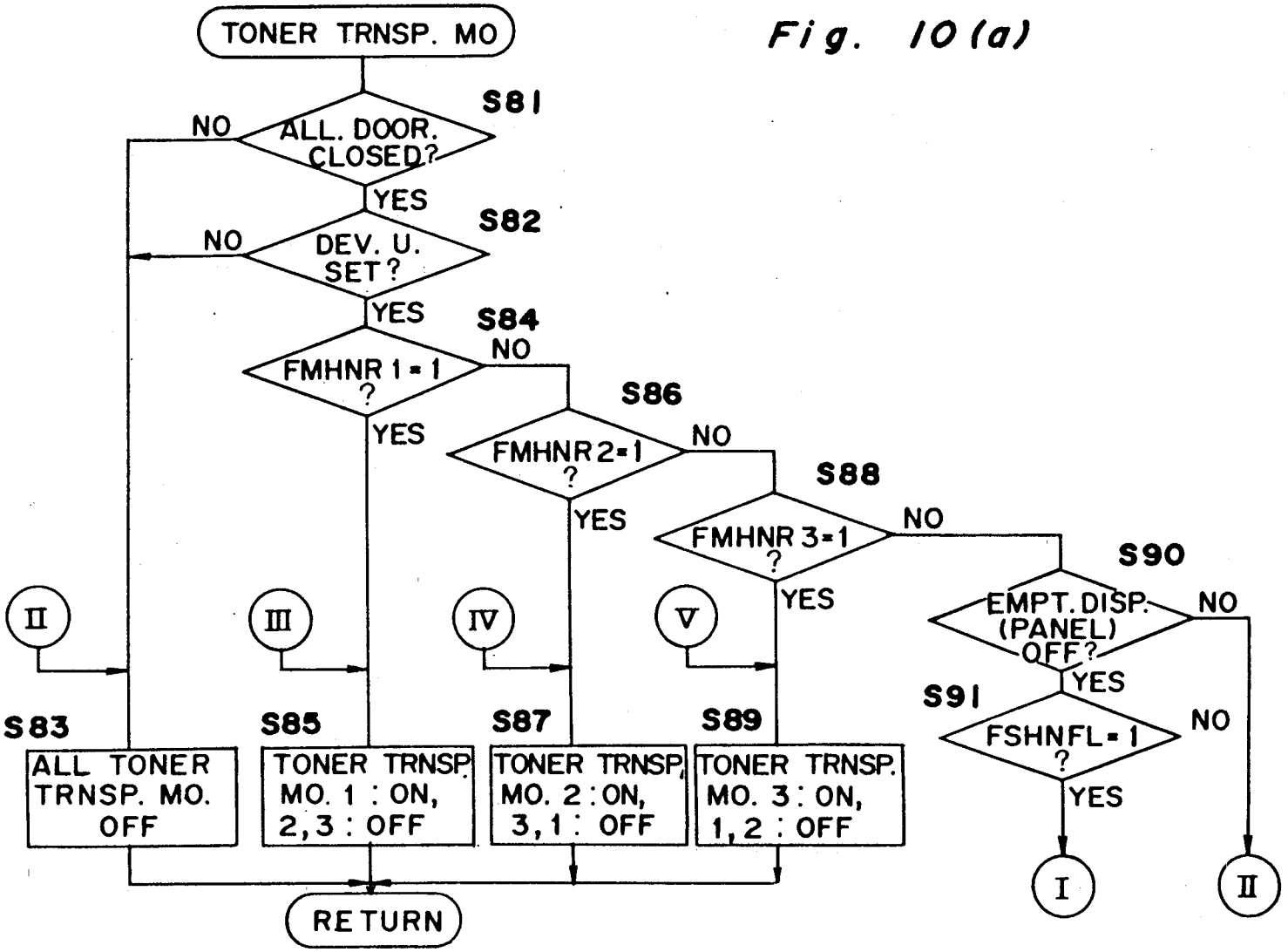
Figure 10B:
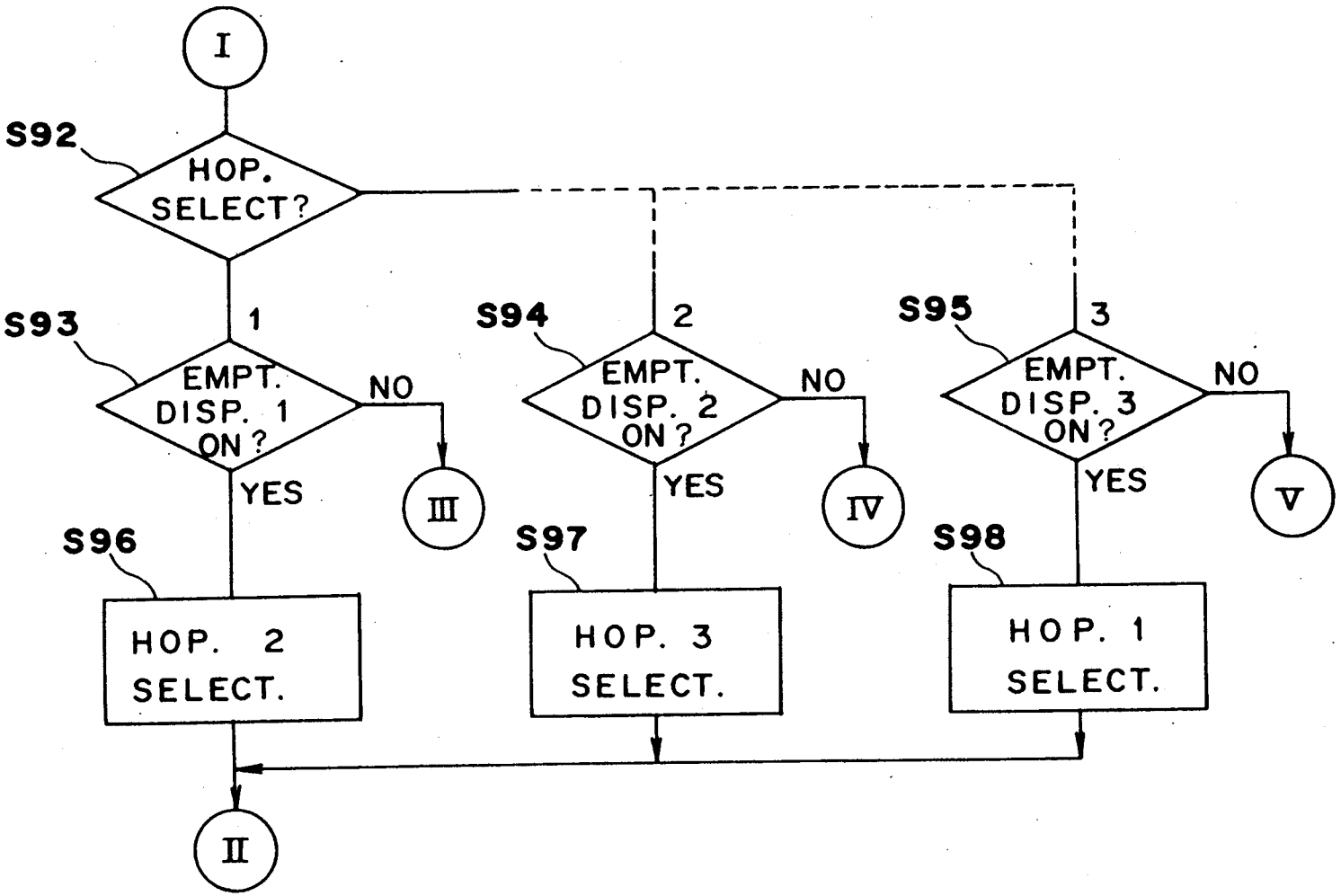

<Toner transport motor control: FIGS. 10(*a*) and 10(*b*)>

Here, driving control of the toner transport motors 26 is executed.

At Step S81, it is judged whether or not the door members 22 for all the main hoppers 20 are kept closed, and if all the door members 22 are closed, the procedure proceeds to Step S82 to see if the developing apparatus 1 is in a state capable of effecting the development. Thus, when all the door members 22 have been closed, with the developing apparatus 1 being in a state ready to effect development, the procedure proceeds to Step S84, and in other states than above, i.e. in the case where even any one of the door members 22 is open, or when the developing apparatus 1 is in a state incapable of effecting the developing, driving of all the toner transport motors 26 is suspended at Step S83.

At Step S84, it is judged whether or not the FMHNR 1 with respect to the main hopper 20*a* is "1", and if it is found to be "1", the motor 26*a* is driven for the predetermined period of time at Step S85, with the motors 26*b* and 26*c* for the other main hoppers 20*b* and 20*c* being stopped. On the other hand, if the judgement is "0", the procedure advances to Step S86.

At Step S86, it is judged whether or not the FMHNR 2 with respect to the main hopper 20*b* is "1", and if it is judged to be "1", the motor 26*b* is driven for the predetermined period of time at Step S87, while the motors 26*c* and 26*a* for the other main hoppers 20*c* and 20*a* are stopped. Meanwhile, if the judgement is "0", the procedure advances to Step S88.

At Step S88, it is judged whether or not the FMHNR 3 with respect to the main hopper 20*c* is "1", and if it is found to be "1", the motor 26*c* is driven for the predetermined period of time at Step S89, with the motors 26*a* and 26*b* for the other main hoppers 20*a* and 20*b* are stopped. On the other hand, if the judgement is "0", the procedure advances to Step S90.

Upon judgement that all the FMHNR are not "1" in the foregoing steps S84, S86 and S88, it is judged, at Step S90, whether or not the empty display lamp 32 on the control panel 30 is in the off state, and if said lamp 32 is off, another judgement is made at Step S91 as to whether or not the FSHNFL 1 is "1", i.e. whether or not the toner amount of the sub-hopper 12 is below the predetermined amount.

In the case where the empty display lamp 32 is in the off state, with the amount of toner in the sub-hopper 12 being below the predetermined amount, the procedure proceeds to Step S92. In cases other than the above, i.e. when the empty display lamp 32 is lit, or when the toner above the predetermined amount is present, the procedure returns to Step S83, with all of the toner transport motors 26 being stopped.

At Step S92, the main hopper 20 currently supplying the toner is detected.

In the case where the innermost hopper 20*a* has been selected, lighting of the empty display lamp 28*a* is checked at Step S93. If the lamp 28*a* is illuminated, the main hopper to supply the toner is changed over to the central main hopper 20*b* at Step S96. On the other hand, when the lamp 28*a* is in the off state, the procedure returns to Step S85. Similarly, in the case where the central main hopper 20*b* has been currently selected, lighting of the lamp 28*b* is checked at Step S94. If the empty display lamp 28*b* is lit, with the main hopper 20*b* in the toner empty state, the main hopper to supply the toner is changed over to the front side main hopper 20*c* at Step S97. On the other hand, when the empty display lamp 28*b* is in the off state, the procedure returns to Step S87.

Furthermore, in the case where the front side main hopper 20*c* has been currently selected, the lamp 28*c* is checked for lighting at Step S95. If the lamp 28*c* is in the on state, with the main hopper 20*c* in the toner empty state, the main hopper to supply the toner is changed over to the innermost main hopper 20*a*, at Step S98. On the other hand, if the empty display lamp 28*c* is in the off state, the procedure returns to Step S88.

In the case where any of the door members 22 is opened by the processings in the Steps from Step S81 to S89, all of the toner supply functions are once stopped. Subsequently, in the state where all of the door members 22 are closed, the toner transport motor 26 is driven in the main hopper 20 in the state of toner empty. Meanwhile, by the main hopper detection control referred to earlier, the toner empty state of the main hopper 20 driven by the tone transport roller is judged. Thus, if the toner is replenished when the door member 22 is opened, the empty display lamp 28 is turned off then. On the other hand, if the door member 22 is merely opened, without replenishment of toner, the lit state of the empty display lamp 28 is maintained.

Figure 11:
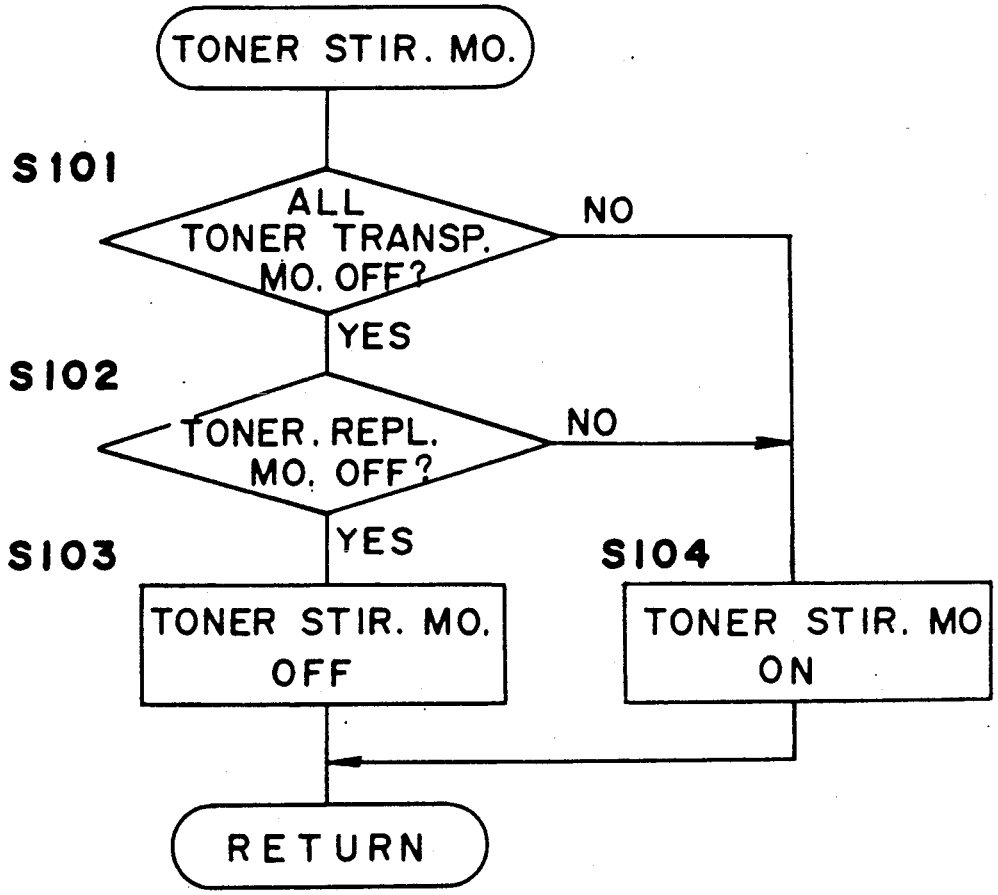
FIG. 11 is a flow-chart for a toner stirring motor control.

<Stirring motor control: FIG. 11>

Here, driving control of the toner stirring motor 16 at the sub-hopper 12 is effected.

At Step S101, it is judged whether or not all of the toner transport motors 26 are turned off.

In the case where all the toner transport rollers 26 are in the stopped state, it is checked, at Step S102, whether or not the toner replenishing motor 17 is not being driven, and if said motor 17 is in the non-driven state, driving of the toner stirring motor 16 is suspended. Meanwhile, if the toner replenishing motor is being driven, the toner stirring motor 16 is driven at Step S104.

In the case where any of the toner transport motors 26 is judged to be in the driven state at Step S101, the toner stirring motor 16 is driven at Step S104.

In other words, the toner stirring motor 16 is driven only when any of the toner transport motors 26 is in a driven state or the toner replenishing motor 17 is being driven.

As is clear from the foregoing description, the toner supply arrangement according to the present invention includes the plurality of toner hoppers added to a developing apparatus, the transport means for transporting toner accommodated in the respective toner hoppers to said developing apparatus, the toner detecting means for detecting the toner accommodated within said toner hoppers, the door means for selectively closing or opening open portions of said toner hoppers, the open/close detecting means for detecting opening or closing of said door means, and the control means which controls to use said toner hoppers by a predetermined order, and to effect toner supply function after having ensured toner empty state of the respective toner hoppers upon opening or closing of said door means.

Accordingly, since the toner is accommodated in the plurality of toner hoppers, even if the toner amount accommodated in each toner hopper is small, a large amount of toner may be contained in the image forming apparatus on the whole.

Furthermore, it is so arranged that the toner empty state is first checked upon opening or closing of the door member for any of the toner hoppers. In other words, the toner empty state is not released, even if the door member is merely opened or closed. Therefore, toner supply with respect to the developing apparatus is positively effected.

It is to be noted here that in the foregoing embodiment, although the procedure for using the plurality of main hoppers 20*a*, 20*b* and 20*c* in the order from the main hopper 20*a* disposed at the innermost side of the image forming apparatus towards those 20*b*, 20*c* arranged at the forward side is explained as one example, the procedure is not limited to the above, but the main hoppers may be used in the reverse order from the main hopper 20*c* at the foremost side towards in the innermost one 20*a*.

It should also be noted here that in the foregoing embodiment, although the driving motor is described as provided for each of the main hoppers, the arrangement may, for example, be so modified that a driving transmission means such as an electromagnet clutch or the like is provided in each of the main hoppers so as to obtain a driving force for rotating each spiral member by a single motor.

Although the present invention has been fully described by way of example with reference to the accompanying drawings, it is to be noted here that various changes and modifications will be apparent to those skilled in the art. Therefore, unless other wise such changes and modifications depart from the scope of the present invention, they should be construed as included therein.

What is claimed is:

1. A toner supply arrangement for use in a developing apparatus, which comprises:

a plurality of toner accommodating containers provided in said developing apparatus;

a toner transport means for transporting toner accommodated in each of said plurality of toner accommodating containers to said developing apparatus;

a driving means for driving said toner transport means;

a first toner detecting means for detecting presence or absence of toner accommodated in each of said plurality of toner accommodating containers;

a cover member for selectively opening or closing an opening for each of said plurality of toner accommodating containers;

an open/close detecting means for detecting opening or closing of said cover member; and a control means for actuating said first toner detecting means upon detection of the opening or closing of said cover member so as to apply a control signal to said driving mean according to the detected result of said toner detecting means.

2. A toner supply arrangement as claimed in claim 1, wherein said developing apparatus is provided with a toner containing chamber for temporarily storing tone transported from any one of said plurality of toner accommodating containers, said toner containing chamber being provided with a second toner detecting means for detecting presence or absence of toner accommodated therein.

3. A toner supply arrangement as claimed in claim 2, wherein said control means is arranged to apply a control signal to said driving means according to both of the detected results of said first toner detecting means and that of said second toner detecting means.

4. A toner supply arrangement as claimed in claim 1, further including a display means for displaying the detected result of said first toner detecting means, said display means including a display unit provided on each of said plurality of toner accommodating containers.

5. A toner supply arrangement for use in a developing apparatus, which comprises:

a plurality of toner accommodating containers provided in said developing apparatus, a toner detecting means for detecting presence or absence of toner accommodated in each of said plurality of toner accommodating containers;

a memory means for memorizing a detected result of said toner detecting means;

a cover member for selectively opening or closing an opening for each of said plurality of toner accommodating containers;

an open/close detecting means for detecting opening or closing of said cover member; and a control means for controlling functioning of said toner detecting means according to the detected result memorized in said memory means, upon detection of the closing of said cover member by said open/close detecting means.

6. A toner supply arrangement as claimed in claim 5, further including a toner transport means for transporting toner accommodated in each of said plurality of toner accommodating containers to said developing apparatus, and a driving means for driving said toner transport means, said control means actuating said toner detecting means upon detection of the closing of said cover member so as to apply a control signal to said driving means in response to the result of detection of said toner detecting means.

7. A toner supply arrangement as claimed in claim 5, further including a display means for displaying the detection result of said toner detecting means, said display means including a display unit provided on each of said plurality of toner accommodating containers.

8. A toner supply arrangement for use in an image forming apparatus, which comprises:

a first toner accommodating container means including a plurality of chambers each accommodating toner therein;

a second toner accommodating container means for accommodating toner therein;

a toner transport means for transporting toner from each of the chambers of said first toner accommodating container means to said second toner accommodating container means, said toner transport means including a plurality of transport members;

a driving means for driving said toner transport means, said driving means including at least one driving source, and a control means for applying control signals to said plurality of driving sources in a predetermined order.

9. A toner supply arrangement as claimed in claim 8, wherein said image forming apparatus has a developing apparatus, the respective chambers of said first toner accommodating container means being arranged in a predetermined direction with respect to said developing apparatus.

10. A toner supply arrangement as claimed in claim 8, further including a first toner detecting means for detecting presence or absence of toner accommodated in each of the chambers of said first toner accommodating container means, and a second toner detecting means for detecting presence or absence of toner accommodated in said second toner accommodating container means.

11. A toner supply arrangement for use in an image forming apparatus, which comprises:

a first toner accommodating container means including a plurality of chambers each accommodating toner therein;

a second toner accommodating container means for accommodating toner therein;

a toner transport means for transporting toner from each of the chamber of said first toner accommodating container means to said second toner accommodating container means;

a driving means for driving said toner transport means;

a first toner detecting means for detecting presence or absence of toner accommodated in each of the chambers of said first toner accommodating container means;

a second toner detecting means for detecting presence or absence of toner accommodated in said second toner accommodating container means; and a control means arranged to apply a control signal to said driving means according to both of the detected results of said first toner detecting means and that of said second toner detecting means.

12. A toner supply arrangement as claimed in claim 11, wherein said toner transport means includes a plurality of transport members disposed between the respective chambers of said first toner accommodating container means and said second toner accommodating container means, said driving means having a plurality of driving sources.

13. A toner supply arrangement as claimed in claim 12, further including a memory means for memorizing the result of detection of said first toner detecting means for each of the chambers of said first toner accommodating container means, said control means being arranged to call out the memorized detection result from said memory means in a predetermined order in response to the detected result of said second toner detecting means.

14. In an image forming apparatus, a developing apparatus for developing an electrostatic latent image formed on an image support member comprises:

a developing means for supplying toner to said electrostatic latent image;

a plurality of toner accommodating containers, each containing toner therein;

a toner transport means for transporting toner to said developing means from any one of said plurality of toner accommodating containers;

a driving means for driving said toner transport means; and a control means for applying a driving signal to said driving means in a predetermined order.

15. A developing apparatus as claimed in claim 14, further including a toner detecting means provided on each of said plurality of toner accommodating containers for detecting presence or absence of the toner accommodated in said toner accommodating container, said control means being arranged to apply the driving signal to said driving means in response to a detected result of said toner detecting means.

16. A developing apparatus as claimed in claim 15, wherein said control means is arranged to actuate said toner detecting means upon starting of said image forming apparatus.

17. A developing apparatus as claimed in claim 14, further including a cover member for selectively opening or closing an opening of each of said plurality of toner accommodating containers and an open/close detecting means for detecting opening or closing of said cover member, said control means being arranged to stop driving of said toner transport means upon detection of an opening or closing of said cover member during driving of said toner transport means.

18. In an image forming apparatus, a developing apparatus for developing an electrostatic latent image formed on an image support member, comprises:

a plurality of toner accommodating containers provided in said developing apparatus, each containing toner therein;

a toner detecting means for detecting presence or absence of toner accommodated in each of said plurality of toner accommodating containers;

a display means for displaying the detected result of said toner detecting means; and a control means for actuating said display means when all of said toner accommodating containers are detected to be in an absence state of toner.

19. An image forming apparatus as claimed in claim 18, wherein said display means is provided on a control panel of said image forming apparatus.

20. A developing apparatus as claimed in claim 14, wherein said toner transport means is provided for each of the plurality of said toner accommodating containers, and said driving means includes a plurality of driving motors, said control means being arranged to apply a driving signal to any one of said plurality of motors.

* * * * *